US010479464B2

(12) United States Patent
Busch

(10) Patent No.: US 10,479,464 B2
(45) Date of Patent: Nov. 19, 2019

(54) WATER RESCUE SYSTEM

(71) Applicant: Dennis G. Busch, Nelson, WI (US)

(72) Inventor: Dennis G. Busch, Nelson, WI (US)

( * ) Notice: Subject to any disclaimer, the term of this patent is extended or adjusted under 35 U.S.C. 154(b) by 0 days.

(21) Appl. No.: 15/669,792

(22) Filed: Aug. 4, 2017

(65) Prior Publication Data

US 2018/0154991 A1 Jun. 7, 2018

Related U.S. Application Data

(60) Provisional application No. 62/371,050, filed on Aug. 4, 2016.

(51) Int. Cl.

| | |
|---|---|
| ***B63C 9/00*** | (2006.01) |
| ***B63C 9/26*** | (2006.01) |
| *B63C 9/13* | (2006.01) |

(52) U.S. Cl.

CPC . *B63C 9/26* (2013.01); *B63C 9/13* (2013.01)

(58) Field of Classification Search

CPC .... B63C 9/00; B63C 9/08; B63C 9/11; B63C 9/13; B63C 9/135; B63C 9/26; B63C 9/32; B63C 2009/00; B63C 2009/08; B63C 2009/13; B63C 2009/131; B63C 2009/133; B63C 2009/26

USPC ..... 441/80, 82, 83, 84, 88, 106

See application file for complete search history.

(56) References Cited

U.S. PATENT DOCUMENTS 1,443,121 A * 1/1923 Fogg ..... B63C 9/26 135/75
1,759,054 A * 5/1930 Laub ..... A01K 15/003 119/802
2,179,394 A * 11/1939 Wulff ..... A01K 97/14 119/804
2,499,511 A * 3/1950 Koger ..... A01K 15/003 119/803
2,704,052 A * 3/1955 Wood ..... A01K 15/003 119/804
4,593,933 A * 6/1986 Nunno ..... A63C 11/222 280/812
4,596,530 A * 6/1986 McGlinn ..... B63C 9/26 119/805
4,599,074 A * 7/1986 Beckly ..... B63C 9/26 114/221 R
4,635,986 A * 1/1987 Johns ..... B63B 21/54 114/221 R
5,003,907 A * 4/1991 Roach ..... B63B 21/54 114/221 R
5,292,160 A * 3/1994 Deichman ..... B63B 21/54 114/221 R
5,538,302 A * 7/1996 Travis ..... B25J 1/04 294/209
5,586,514 A * 12/1996 Yuscavage ..... B63B 21/54 114/221 R (Continued)

*Primary Examiner* — Daniel V Venne
(74) *Attorney, Agent, or Firm* — Brooks, Cameron & Huebsch, PLLC

(57) ABSTRACT

Water rescue systems, devices, and methods are disclosed herein. One water rescue system, includes, one or more poles, with one or more J-hooks attached thereto; and a sling made from a length of line to form a loop sized to accommodate a torso of a victim to be rescued from a body of water, and wherein one of the one or more J-hooks is positioned to hold the sling in position during the placement of the sling over the victim.

14 Claims, 7 Drawing Sheets

(56) References Cited

U.S. PATENT DOCUMENTS

| | | | | |
|---|---|---|---|---|
| 5,752,731 | A * | 5/1998 | Crone | A62B 99/00 119/802 |
| 6,050,869 | A * | 4/2000 | Kellett | A62B 1/16 182/3 |
| 6,067,942 | A * | 5/2000 | Fernandez | A01K 15/003 119/802 |
| 6,575,799 | B1 * | 6/2003 | Stimpson | A62B 1/00 441/80 |
| 8,360,813 | B1 * | 1/2013 | Alvarez | B63B 21/54 114/221 R |
| 8,627,839 | B1 * | 1/2014 | Martinez | A45B 3/00 135/66 |
| 9,096,298 | B1 * | 8/2015 | Alvarez | B63C 9/26 |
| 2011/0134635 | A1 * | 6/2011 | Feldman | B63C 9/26 362/234 |
| 2014/0014149 | A1 * | 1/2014 | Jackson | A45B 3/00 135/66 |
| 2017/0210452 | A1 * | 7/2017 | Birkin | B63C 9/11 |

* cited by examiner

WATER RESCUE SYSTEM

TECHNICAL FIELD

The present disclosure relates to water rescue systems and methods.

BACKGROUND

In the field of water rescue, there can be significant danger to the rescuer. For example, the rescuer can be injured by the person or object being rescued. For the purpose of the present disclosure, a "person or object" being rescued can be a human, an animal, or an inanimate item the needs to be recovered from a dangerous situation that may harm the person, animal, or item. Injury can, for example, be caused by the rescuer coming into contact with the person or object and that contact causing the injury, the person or object tangling up with the rescuer and thereby putting the rescuer in the same dangerous situation as the person or object, or a different danger (e.g., the person or object pushing the rescuer under the water in an attempt to stay above the water themselves). Further, in some instances, the dangerous situation surrounds the person or object to be rescued and therefore, getting near the person or object puts the rescuer in harm's way (e.g., a rescue on thin ice).

DETAILED DESCRIPTION

The present disclosure includes systems that can be used in such dangerous rescue situations to reduce the danger encountered by the rescuer and may potentially increase the ability for rescue personnel to accomplish a successful rescue. Several different systems are shown in the accompanying drawings and described herein.

Water rescue systems, devices, and methods are disclosed herein. One water rescue system, includes, one or more poles, with one or more J-hooks attached thereto; and a sling made from a length of line to form a loop sized to accommodate a torso of a victim to be rescued from a body of water, and wherein one of the one or more J-hooks is positioned to hold the sling in position during the placement of the sling over the victim.

For example, in some embodiments, the system includes a sling as shown in the first figure. In other embodiments, the system can include a water rescue pole, as shown in the second figure. Further, in some embodiments, the system can include an extension pole having multiple sections. In some embodiments, the pole or portions thereof can be constructed of buoyant materials so that the pole or portions thereof will float. This can be beneficial if the pole is dropped into the water and/or if a portion of the pole is positioned in the water during the rescue of the victim.

Figure 1:
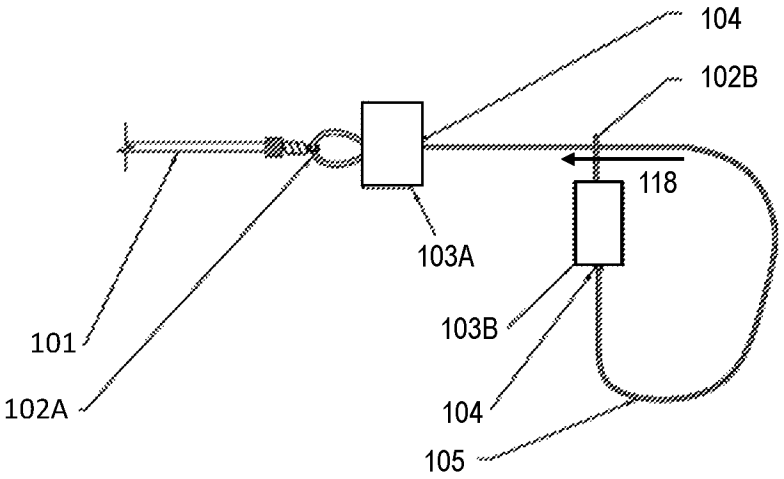
FIG. 1 illustrates a side view of a sling assembly of a water rescue system according to the embodiments of the present disclosure.

FIG. 1 illustrates a side view of a sling assembly of a water rescue system according to the embodiments of the present disclosure. In the embodiment shown in the first figure, the system includes a sling assembly having a first length of line 105, having a first eye formed by a thimble 102A at a first end, and a second eye formed by a second thimble 102B at a second end, a first float 103A provided proximate to the first end of the first length of line, a second float 103B provided proximate to the second end of the first length of line, a swag 104, and a second length of line 101 connected to the first end of the first length of line via thimble 102A. The cable 105 forms a loop (referred to as the sling herein) which can be used to loop around an object or person to be rescued. As discussed herein, systems may have more or less components as described and shown in the other figure provided herewith.

The rope 101 (a second length of line) is used to allow an operator of the system to control the size (perimeter) of the loop formed by the cable 105 (a first length of line) from a location that is remote from the loop itself. This allows the operator to operate the system with reduced risk of injury from the dangers that are affecting the person or object being rescued. The rope can also be less rigid than the cable, allowing it to be more easily pulled, wrapped, and/or maneuvered than the cable, among other benefits.

Although a non-floating rope can be used in some embodiments, a floating rope can be beneficial in allowing a user of the system to identify where the rope is in the water at all times during a rescue. Although any suitable rope can be used, one suitable rope can, for example be a ⅜ inch diameter floating rope that is 25 feet in length. One suitable type of rope is a poly braid floating rope with a work load of 450 pounds or more.

Thimble 102B is used to make a loop at the end of a cable. In this manner, the cable can form a loop that can be used to wrap around the person or object to be rescued. Any suitable structure that allows the loop to be formed can be utilized. One suitable thimble is formed with a ¼ inch steel cable eyelet that is attached to the cable to form an eye.

One benefit of using a thimble is that it allows a portion of the cable to form an eye via the thimble and another portion of the cable to pass through the thimble eye. This can also be beneficial as it can reduce or eliminate the friction from the cable or a coating (such as a plastic or rubberized coating on metal cable, such as steel or aluminum). This structure also can allow for the cable to loop easier to tighten upon itself.

In some embodiments, the sling is made from a non-buoyant material. This, for example, allows the sling to sink into the water, which may be beneficial in allowing a victim in the water to arrange it around their torso and/or other body parts.

In some embodiments, the sling can have a float on either end which will allow one or both ends to be buoyant. This may be beneficial in helping the victim locate one or both ends of the sling and may keep the sling generally vertical in the water, which may be helpful for the victim when attempting to get into the sling. For example, in some embodiments, the sling can include one or more floats and wherein at least one float is positioned at a first end of the sling and at least one float is positioned at a second end of the sling.

Floats, such as floats 103A and 103B shown in the first figure, can be used in several ways. For example, when two floats, such as 103A and 103B are used, they allow most of the length of the cable to sink into the water while holding the ends of the cable on top of the water.

When properly sized floats are utilized, once the two floats are placed onto the cable they will hold the weight of entire sling from sinking to the bottom of the water (to the bottom of a lake, for example). A suitable type of float for use in such embodiment, are those made for marine use and those used to hold ropes and nets on top of the water. Although the buoyancy of the floats will vary based on the other components of the system, suitable buoyancy for the floats would be, for example, a float can hold up four pounds of weight in the water. In some embodiments, they can be filled with air or other buoyant material.

Further, in embodiments where one or both of the sling pole and the sling include one or more floats or are buoyant, the combination of the pole, sling, and one or more floats are buoyant enough to float the system. In this manner, the system cannot be lost by it being dropped into the water and sinking.

Further, in some embodiments, the floats may be of different colors. For example, with two different colored floats (e.g., one placed at each end of the cable) coordination of the placement of the cable ends of the sling onto the rescue pole (shown in the second figure) can be color coordinated to make assembly of such a system easier for the rescuer. An example of the two colors could, for example, be red and yellow.

This can allow less experienced users to utilize such systems and/or can speed the recovery time of the person or object being rescued. Other suitable features of the floats can include the float being made of plastic (which adds durability to the system), a relatively small diameter (e.g., 3 inches round×5 inches long) which allows them to provide proper floatation without getting in the way and/or can be grabbed by the person or object being rescued), and hole through the center of the float to maintain the cable in position through uniform floatation of the cable.

The system shown in the first figure also includes a number of swags 104. Swags are used to form loops in the cable by attaching one portion of the cable to another portion of the cable (e.g., an end of the cable is attached via the swag to a portion near then end of the cable such that a loop is formed by the portion of the cable between the end and the portion to which the end is attached). A suitable swag can be formed from ¼ inch aluminum among other materials. Although swags are illustrated, the attachments used to make the loops can be made by any other suitable attachment mechanisms.

As used herein, the sling is the portion of the cable forming the loop that is placed around the person or object to be rescued. The perimeter of the loop can be reduced by pulling on the cable 105 to move a portion of the cable through the thimble 102B to shorten the amount of cable used to form the loop as illustrated by arrow 118. The cable can be any suitable type of cable for encircling a person or object to be rescued.

Suitable types of cable include cables made of aluminum, galvanized steel, or stainless steel. Such examples, can be beneficial as they are generally non-corrosive and which can increase the effectiveness of the system, among other benefits. Some embodiments can have a plastic or rubberized coating covering the cable. The coating can, for example, be applied to the cable at the cable factory. Such a coating can have several benefits, as described above.

Although the sling may have any suitable dimensions, one example of a cable length can, for example, be eight feet. This length can be beneficial as it creates a loop that will go around the body of a person's, arm, and chest or both arm's and chest, but is not too big such that it can become twisted or such that the person being rescued cannot locate the cable.

Figure 2:
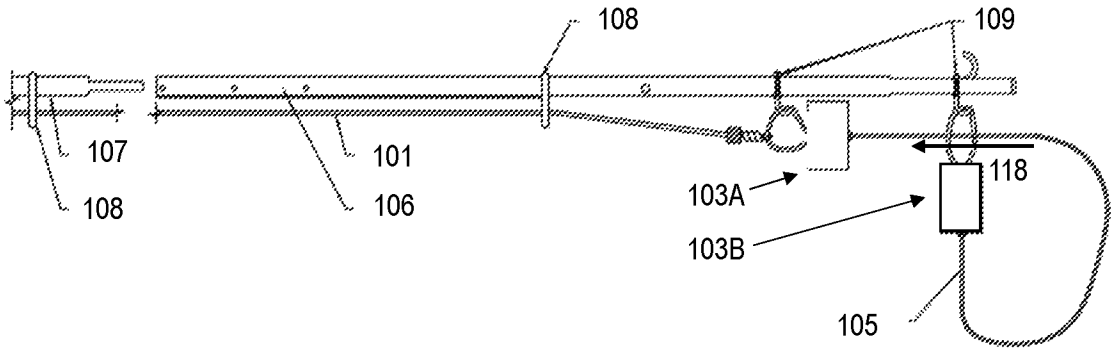
FIG. 2 illustrates a side view of another water rescue system according to the embodiments of the present disclosure.

FIG. 2 illustrates a side view of another water rescue system according to the embodiments of the present disclosure. The system of the second figure includes the elements of the first figure and additionally includes a sling pole and an extension pole. The use of the sling pole provides significant rigidity to the system allowing for significantly more force to be applied to aid in rescuing the person or object. However, the extension sections that can be added to the pole allow the system to be used farther away from the user, which may be beneficial in some situations.

Additionally, the sling pole 106 allows the sling 105 to be positioned above the person or object being rescued. This can provide many additional angles to present the sling to the person or object being rescued and/or many different extrication angles once the person or object (victim) has been secured with the sling.

Although the pole can be of any suitable length, one suitable length is six feet. The pole can, for example, be constructed of rigid tubing (e.g., 1⅜ inch aluminum tubing) or a solid bar/column of material so long as the material is rigid enough and strong enough to support the person or object to be rescued.

When a metal pole is used, the material can be heat treated for strength and/or durability. Such a process can also create a pole that is light in weight. It can also be anodized on the outside. Anodizing the material provides a protective coating.

In some embodiments, holes can be provided in the pole for attachment of a number of additional components. In some embodiments, the pole can be provided with predrilled holes from the manufacturer. Additionally, in some embodiments, one end of the tube can be reduced in size (e.g., to 1¼ inch), so that it will slide into a large end of another tube (e.g., an extension pole) or vice versa. On the end of the tube that has been reduced, a detent (e.g., a steel spring button device) can be provided that will lock into a predrilled hole on the large end of another tube to prevent detachment of the extension pole and the sling pole.

As discussed herein, the pole can hold a rope along its length and a sling formed near the end. In some embodiments, the rope and sling are different materials. For example, the sling can be made from a non-buoyant material and the rope can be attached to or near one end of the sling and can be a buoyant material. The rope can be of any suitable length. However, in some embodiments, the rope is long enough for an end of the rope to be held by a user holding the pole.

As shown in the second figure, the sling pole can have a number of additional components that engage with the rope 101 or the cable (e.g., a cable can be used to form the sling and a rope attached thereto can be used to control the sling by a user, for example, holding the pole). Such components can assist, for example, in supporting the weight of the person or object being rescued and/or assist in maintaining the positioning of the sling and/or the rope to help make the system easy to use and not allow any of the components to tangle with each other or the person or object being rescued.

Further, in some embodiments, J-shaped hooks (e.g., components 108 and 109) can be mounted in the holes provided in the pole. J-shaped hooks can be beneficial in many instances because the rope 101 or cable or eyes formed therein can be positioned such that they are hooked on or supported by the J-shaped hooks as illustrated in the second figure and then the rope or cable may easily be removed, such as when the person or object has been moved to a safer location, making it easier to get out of the sling, in some instances. The use of J-hooks can be beneficial in many ways.

For example, when positioned on the pole a shown in FIG. 2, the pole can be rotated (e.g., 90 degrees) along its elongate axis (e.g., the axis through the center of the pole that travels down its length) and the sling will be released from the pole. For instance, in some embodiments, the one or more J-hooks are positioned on the one or more poles to allow the one or more poles to be rotated along their elongate axis to release the sling from at least one of the J-hooks.

The embodiment of the second figure also includes an extension pole 107. As with the sling pole, the extension pole can be of any suitable length. One such suitable length is six feet. The extension pole can, for example, be constructed of rigid tubing (e.g., 1⅜ inch aluminum tubing) or a solid bar/column of material so long as the material is rigid enough and strong enough to support the person or object to be rescued.

When a metal pole is used, the material can be heat treated for strength and/or durability. Such a process can also create a pole that is light in weight. It can also be anodized on the outside. Anodizing the material provides a protective coating.

Similarly to the sling pole, other extension poles can be attached to one end of the extension pole to further elongate the sling pole and extension pole combination (e.g., a sling pole with two extension poles attached to each other end to end one end of one of the extension poles attached to an end of the sling pole.

In some embodiments, a stopper can be placed at the opening of the J-shaped hook (e.g., a plastic or rubberized tube placed over the short end of the J-shape). This feature provides that the rope or cable can't be easily removed without the user of the system moving the stopper and then removing the rope or cable.

In some embodiments, the sling can include one or more colored floats. As used herein, colored can mean being entirely a particular color or having a portion that has a particular predetermined color provided thereon. The color can be determined at the time of manufacture or added by a purchaser or user.

In some such embodiments, the one or more J-hooks can also be colored. For instance, in some embodiments, they can be colored such that each colored J-hook corresponds to a corresponding one of the colored floats. In other words, the J-shaped hooks or portions thereof can be color coded to match the colors of the floats. Such a feature allows for easier identification as to which eye is placed on which hook (as shown in the second figure).

Figure 3:
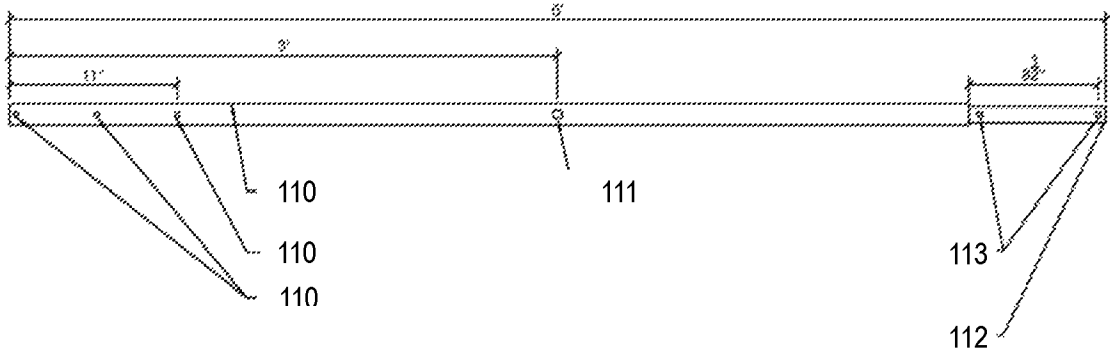
FIG. 3 illustrates a pole for use in embodiments of the present disclosure.

FIG. 3 illustrates a pole for use in embodiments of the present disclosure. The third figure shows an embodiment of the sling pole. In this embodiment, the sling pole includes a number of apertures for attachment of additional components. On the left side of the figure the pole includes three apertures 110 through the pole for attachment, for example, of J-shaped hooks 109.

In some embodiments, all of the poles (extension and sling poles) can be the same and therefore interchangeable. This may allow for easier fabrication by a rescuer and storage of the system. In such an embodiment, the left end of the third figure can be used to attach another extension pole 109 thereto.

The pole also includes an aperture 111 in the middle of the pole and an aperture 112 near the end of the pole. Also shown near the end of the pole is a detent 113 (a spring actuated ball that is seated in a hole on the pole and that engages a corresponding hole in an extension pole to keep to extension pole and the sling pole connected during use).

The pole also has a smaller diameter pole end on the right side of the figure. This smaller diameter can be sized such that it fits inside an aperture in the end of an extension pole.

Figure 4:
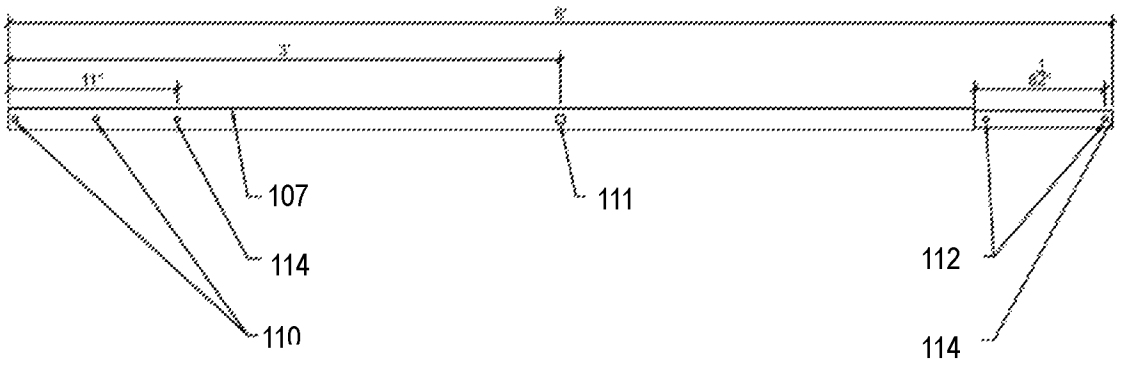
FIG. 4 illustrates another pole for use in embodiments of the present disclosure.

FIG. 4 illustrates another pole for use in embodiments of the present disclosure. In the fourth figure, the pole includes a number of areas that have water tight sealing material 114 provided thereon. Any suitable water tight material can be used to provide the water tight seal. One such material is silicone caulk. The water tight seal can be used to keep water out of some areas of the pole. In the embodiment shown in the fourth figure, the water tight material is positioned to keep water from moving into the middle of the pole when additional components are positioned within the apertures on the pole.

Figure 5:
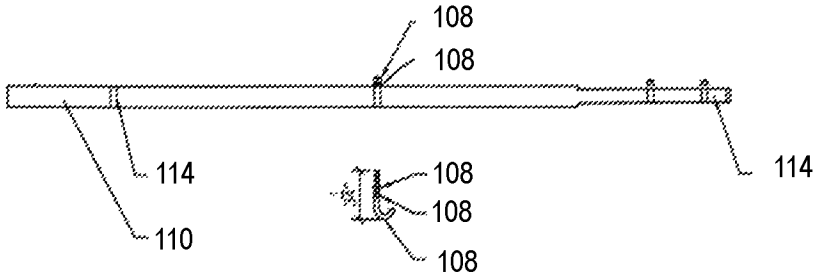
FIG. 5 illustrates the attachment of a J-hook assembly to a pole for use in embodiments of the present disclosure.

FIG. 5 illustrates the attachment of a J-hook assembly to a pole for use in embodiments of the present disclosure.

With respect to the embodiment of the pole shown in the fifth figure, the pole again includes a water tight material 114 inside the pole to keep water out of the middle of the pole. Additionally, a small J-shaped hook is shown positioned to enter the middle aperture on the pole. The J-shaped hook has a threaded portion with a nut and washer near the J-shaped portion of the hook and a washer and nut 108 on the straight, threaded end of the J-shaped hook.

Figure 6:
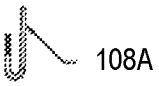
FIG. 6 illustrates a J-hook that can be used in embodiments of the present disclosure.

FIG. 6 illustrates a J-hook that can be used in embodiments of the present disclosure. Also shown in the sixth figure below the fifth figure is a figure of a J-shaped hook with a stopper 108A (e.g., a plastic tube) placed over the hooked end of the J-shaped hook.

The water tight sealing of the ends of the pole can be beneficial in some applications. For example, with both ends filled with water tight material and water tight material applied to any other apertures between the water tight material at the ends, the pole is water tight and can be buoyant based on the weight of the pole. In some applications, if the pole happens to fall into the water it can be easily retrieved.

Figure 7:
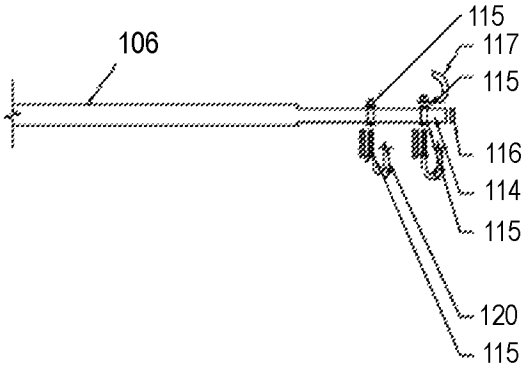
FIG. 7 illustrates the attachment of a J-hook assembly to a pole in the top illustration and some hook embodiments for use in device and system embodiments of the present disclosure in the bottom illustrations.

FIG. 7 illustrates the attachment of a J-hook assembly to a pole in the top illustration and some hook embodiments for use in device and system embodiments of the present disclosure in the bottom illustrations. In some embodiments, as shown in the seventh figure are two J-shaped hooks that are to be attached to a tube 106 of a sling pole.

In this embodiment, the J-shaped hooks each have a threaded portion and that threaded portion is attached to the tube 106 via nuts 115. The right hook also includes a second J-shaped hook 117 attached between the nut 115 and the tube 106. This hook can be used to hook an object or a person to pull them toward the rescuer.

Such a hook can also be used to let the pole user pick up the sling (after deployment) and/or readjust it. As can be understood from the figure, this J-shaped hook can be manufactured with a flat end with a hole in it instead of threads.

Alternatively to, or in addition to, the water tight material within the tube 106, a stopper 116 can be placed in the end of the tube. The stopper 116 can be a water tight material.

Additionally, the stopper can be beneficial because it can protect the person or object in the water from injury, if the end of the pole were to accidently hit them.

In some embodiments, the hooks can be color coded. In the embodiment of the seventh figure, the color coding can be provided via a heat shrink material shrunk over a portion or all of the J-shaped hook (e.g., left hook red, right hook yellow).

In some embodiments, the stopper on the J-shaped end of the hook can be positioned in the following manner. A piece of tubing (e.g., 5/16×2 inches clear plastic) can be split (e.g., 1½ inches) so that it can be applied to the J-shaped hook. With the split end facing the curve in the hook, push the tubing down over the threads so that the split in the tubing goes over the curve of the J-shaped hook.

This can leave approximately 1 inch of tubing below the bottom of the hook. This tube placement can keep the sling from traveling up the backside of the J-shaped hook. This also eliminates the sling's ability to get lodged on the back of the J-shaped hook and prevents the sling from being deployed.

The embodiment of the seventh figure also includes a tube 120. This tube can be placed on the J-shaped hook to prevent the user from accidently deploying the sling too early or to hold the sling firmly in place if a victim in the water should fit the sling before the pole user is ready to deploy the sling. This can be beneficial as sling placement is important when executing a rescue and such an embodiment gives the pole user substantial control during a rescue.

Although specific embodiments have been illustrated and described herein, those of ordinary skill in the art will appreciate that any arrangement calculated to achieve the same techniques can be substituted for the specific embodiments shown. This disclosure is intended to cover any and all adaptations or variations of various embodiments of the disclosure.

It is to be understood that the above description has been made in an illustrative fashion, and not a restrictive one. Combination of the above embodiments, and other embodiments not specifically described herein will be apparent to those of skill in the art upon reviewing the above description.

The scope of the various embodiments of the disclosure includes any other applications in which the above elements and methods are used. Therefore, the scope of various embodiments of the disclosure should be determined with reference to the appended claims, along with the full range of equivalents to which such claims are entitled.

In the foregoing Detailed Description, various features are grouped together in example embodiments illustrated in the figures for the purpose of streamlining the disclosure. This method of disclosure is not to be interpreted as reflecting an intention that the embodiments of the disclosure require more features than are expressly recited in each claim, if claims are provided. Rather, inventive subject matter lies in less than all features of a single disclosed embodiment.

The invention claimed is:

1. A water rescue system, comprising:

a pole comprised of one or more sections;

a first length of line forming a sling made from a portion of the first length of line forms a loop having a perimeter, wherein the perimeter of the loop can be adjusted to accommodate a torso of a victim to be rescued from a body of water; and wherein the first length of line has a first float at a first end attached to the pole and a second float at a second end of the portion of line forming the loop.

2. The water rescue system of claim 1, wherein the first and second floats are different colors.

3. The water rescue system of claim 2, wherein a first J-hook is attached to the pole and is the same color as the first float and a second J-hook is attached to the pole and is the same color as the second float.

4. The water rescue system of claim 1, wherein the first length of line is made from a non-buoyant material allowing the sling to sink into the water and wherein the system includes a second length of line attached to the first length of line and wherein the second length of line is made from a buoyant material.

5. The water rescue system of claim 1, wherein the pole has a first end proximate to the loop and a second end remote from the loop and wherein the sling is attached at or near a first end of a second length of line and the second length of line is long enough for a second end of the second length of line to be held by a user holding the pole near the second end.

6. The water rescue system of claim 1, wherein the one or more sections of the pole are constructed to float.

7. The water rescue system of claim 1, wherein the sling includes an eyelet at a first end of the first length of line and an eyelet at a second end of the first length of line, and wherein the eyelet at the first end of the first length of line is sized to allow the second end of the first length of line to pass through the eyelet at the first end of the first length of line.

8. The water rescue system of claim 1, wherein the sling is attached at or near a first end of a second length of line and wherein the second length of line is made from a buoyant material that will float in the water.

9. The water rescue system of claim 1, wherein one or more of the one or more sections of the pole and sling include two or more floats and wherein a combination of the one or more sections, sling, and two or more floats are buoyant enough to float the system.

10. The water rescue system of claim 1, wherein the pole includes one or more J-hooks positioned on the pole to allow the pole to be rotated along an elongate axis of the pole to release the sling from at least one of the one or more J-hooks.

11. The water rescue system of claim 1, further comprising one or more J hooks attached to the pole, wherein at least one of the one or more J hooks is positioned to hold the sling in position during a placement of the sling over the victim.

12. The water rescue system of claim 1, wherein a first end of the first length of line is attached to the pole such that the first end of the first length of line can be released from the pole.

13. The water rescue system of claim 1, wherein the second end of the first length of line is attached to the pole.

14. The water rescue system of claim 13, wherein the second end of the first length of line is attached such that the second end of the first length of line can be released from the pole.

* * * * *